US005263429A

United States Patent [19]

Brinkmann

[11] Patent Number: 5,263,429

[45] Date of Patent: Nov. 23, 1993

[54] AIRFOIL SAIL

[76] Inventor: Wilhelm Brinkmann, Klapperweg 9, D-5190 Stolberg-Zweifall, Fed. Rep. of Germany

[21] Appl. No.: 868,799

[22] Filed: Apr. 16, 1992

[30] Foreign Application Priority Data

Apr. 29, 1991 [EP] European Pat. Off. ..... 91106945

[51] Int. Cl.[5] ..... B63H 9/06

[52] U.S. Cl. ..... 114/105; 114/90; 114/103

[58] Field of Search ..... 114/102, 103, 104, 106–115, 114/89, 90

[56] References Cited

U.S. PATENT DOCUMENTS

| | | | |
|---|---|---|---|
| 4,016,823 | 4/1977 | Davis | 114/90 |
| 4,116,152 | 9/1978 | Larsson | 114/104 |
| 4,386,574 | 6/1983 | Riolland | 114/103 |
| 4,388,888 | 6/1983 | Gushurst, Jr. | 114/103 |
| 4,561,374 | 12/1985 | Asker | 114/103 |
| 4,612,868 | 9/1986 | Reynolds | 114/103 |
| 4,685,410 | 8/1987 | Fuller | 114/102 |
| 4,702,191 | 10/1987 | Minami et al. | 114/104 |
| 4,757,779 | 7/1988 | Graveline | 114/103 |
| 4,796,554 | 1/1989 | Laib | 114/39.1 |

FOREIGN PATENT DOCUMENTS 242408 10/1987 European Pat. Off. .

*Primary Examiner*—Sherman Basinger
*Attorney, Agent, or Firm*—Shlesinger Arkwright & Garvey

[57] ABSTRACT

Airfoil sail for a sailboat of which the length-adjustable mast consists of several telescoping pipes 12, 18, 20 holding individually raised or reefed sail crossbeams 44, 48, 52 with sail coverings spanning the vertical spacings between said crossbeams. Each crossbeam comprises several horizontal crossbeam sections connected to each other by vertical hinge shafts and jointly corresponding to a symmetric airfoil, which are pivotable for each crossbeam, by a motor adjustment drive, to curvatures optimally matching the wind conditions.

25 Claims, 4 Drawing Sheets

88
96
84
94
124
10
80

AIRFOIL SAIL

BACKGROUND OF THE INVENTION

The invention concerns an airfoil sail for a sailboat consisting of a mast with several sail crossbeams superposed one above the other to be raised or reefed on the mast and between each of which is an external sail covering spanning the maximum vertical spacing, the crossbeams comprising at least two horizontal sections connected to one another by a vertical hinge shaft and jointly corresponding to a symmetrical airfoil, and one of the sections encloses the mast.

OBJECTS AND SUMMARY OF THE INVENTION

In the light of the above described sail design known from the European patent document 242,408 A1, it is the object of the invention to simplify the raising and reefing of the sail sections arrayed one above the other and in the process to match the mast length to the particular sail size, at the same time providing improved adjustability of the curvature of the airfoil sail in order to achieve optimal curvature distribution across the width of the sail.

The invention solves this problem in that the length of the mast consisting of several mutually telescoping pipes is adjustable. The inside pipe bears a fixed top part of the sail which in sideview, evinces an approximately elliptical contour. The sail sections mounted between the top part and the lowermost crossbeam fixed to the outer pipe—as well as the crossbeams themselves to being raised by extending the mast—lend themselves to being raised by extending the mast or to being reefed by means of reefing means acting on the movable crossbeams while at the same time the mast is shortened. To optimally distribute the curvature along the axis of the airfoil the crossbeam sections of each crossbeam that form about the front third of its length can be jointly adjusted by a curvature distribution drive.

Using this design, the listing, ie, the slant of the mast and hence of the boat which is mainly caused by wind forces on the upper end of the sail, can be kept small, and consequently the keel otherwise required for boat stabilization can be made smaller or replaced by a small centerboard. The semi-elliptical contour of the sail is preferred because of its essential aerodynamic advantages. Because of the selected sail shape, the adjustable sail height and the adjustable distribution of sail curvature, it is possible when suitably trimming the sail to take into account and to make better use of laterally incident winds, achieving advantageous propulsion at minimized list.

Further advantageous features and details of the airfoil sail of the invention are stated in the description below. All particulars cited in the description and the claims as well as all those inferable from the drawings further are part of the invention, even when not emphasized.

BRIEF DESCRIPTIONS OF THE DRAWINGS

The invention is elucidated below by the illustrative embodiments shown in the schematic drawings.

FIGS. 1*a*, 1*b*, 1*c* are sideviews of an airfoil sail of the invention respectively in the reefed, half-raised and fully raised states, FIG. 2 is a longitudinal section of the extended mast, FIG. 3 is a topview of the front region of a crossbeam with associated curvature adjustment device, FIGS. 4*a*, 4*b*, 4*c* are topviews of a crossbeam in the extended state and in the left and right curving states, and FIG. 5 is a partial longitudinal section in the region of the upper end of the center and outer pipes of the mast with upper crossbeam and the adapter affixed to the center pipe.

DETAILED DESCRIPTION OF THE INVENTION

Figure 1C:
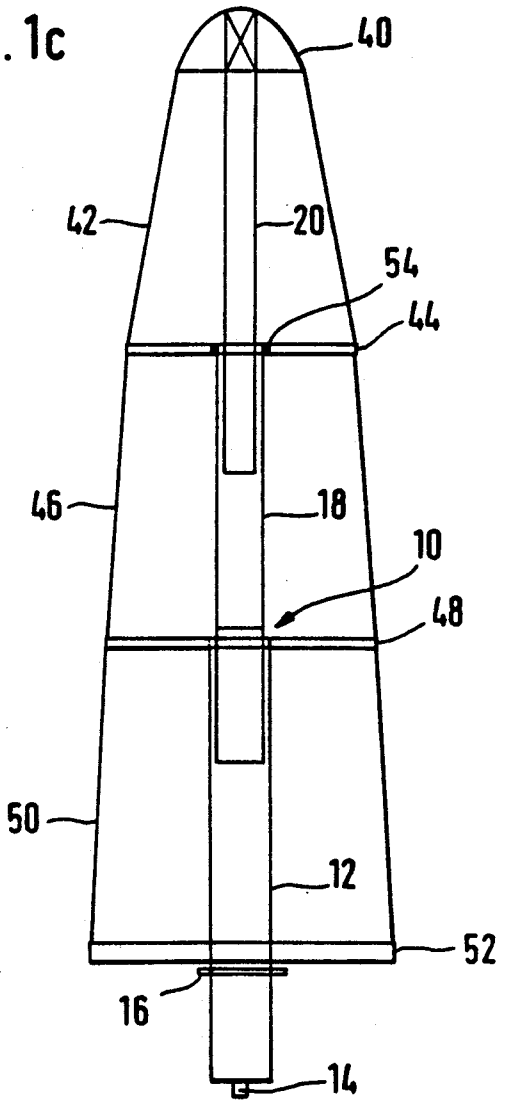
Figure 1B:
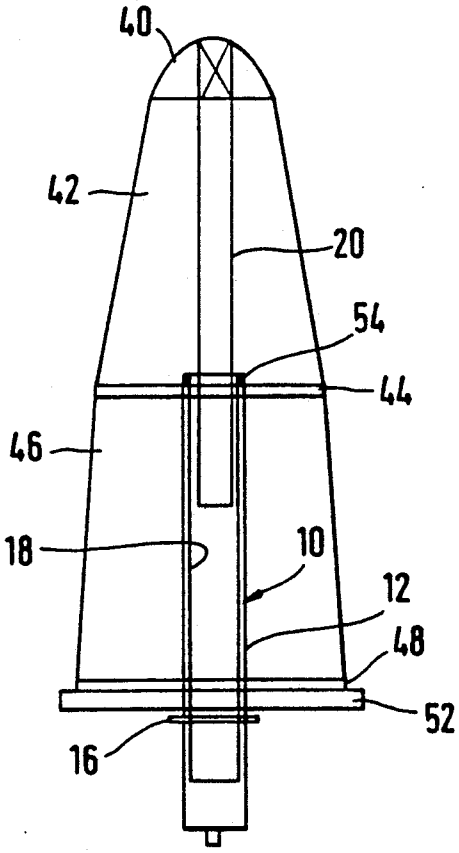
Figure 1A:
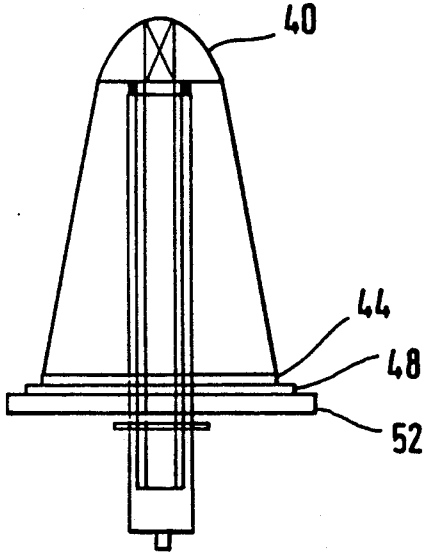
Figure 2:
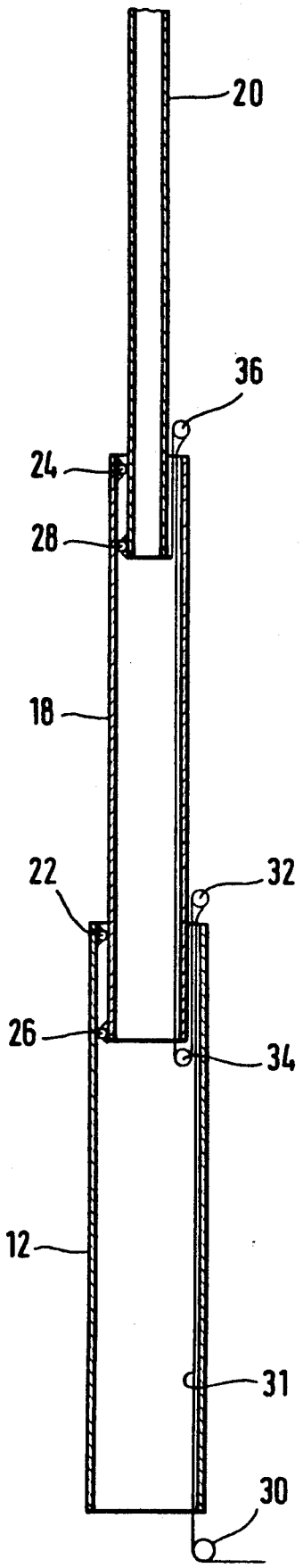

As shown by FIGS. 1 and 2, the airfoil sail comprises a mast 10 consisting of telescoping pipes, of which the outer pipe 12 is supported at its bottom by pivot bearings in an omitted boat hull, a rotary adjustment drive acting on a lower pivot pin 14 of the outer pipe 12. The outer pipe 12 is split above its passage through the deck and is fitted with flanges 16 comprising a common horizontal hinge shaft so that the mast together with the collapsed sail can be tipped over into a trough mounted on or near the deck. A center pipe 18 is present in the outer pipe 12 and in turn guides an inner pipe 20 which when extended will still substantially overlap to prevent bending.

The telescoping pipes 12, 18, 20 are guided inside each other in low-friction manner by means of particular, peripherally spread, inner and higher guide rollers 22, 24 and by outer, peripherally spread, lower guide rollers 26, 28 as shown by FIG. 2. To adjust the height, a winch 30 for a traction member or a traction belt 31 is provided underneath the mast. The belt passes over an external reversal roller 32 at the upper end of the outer pipe 12 and over lower and upper reversing rollers 34 and 36 respectively of the center pipe 18 as far as the lower end of the inner pipe 20. As regards a three-member mast as shown in FIG. 2, of which the outer pipe 12 is fixed, a lock shown in FIG. 5 is present at the upper end of the center pipe 18 in order that the center pipe shall be held in the outer pipe in order that during the extension motion, the inner pipe 20 shall be first driven by the winch 30.

The contour of the raised sail as shown in FIGS. 1*b*, 1*c* is approximately half an ellipse so that the shape of the upper sail end is determined by the small ellipse axis. This sail end is formed by a top part 40 affixed to the upper side of the inner pipe 20 and which, after the mast has been retracted and the sail has been collapsed, as shown in FIG. 1*a*, remains above the in-telescoped mast pipes. An upper sail section 42 is suspended from the top part 40 and is bounded downward lengthwise by an upper crossbeam 44 and in its cross-section corresponds to an airfoil. A central sail section 46 extends from the upper crossbeam 44 to a middle crossbeam 48 and a lower sail section 50 extends from the central crossbeam 48 to a lower crossbeam 52 affixed to the outer pipe 12. The crossbeams 44 and 48 are suspended from the sail sections 42 and 46, respectively. Thus, the sail sections and the respective crossbeams sections are raised by lengthening the mast. As shown by FIG. 2, the crossbeams 44, 48 are guided along the outer pipe 12 that evinces a polygonal, for instance square, cross-section, as do also the other pipes. Because the upper crossbeam 44 must rest on the center pipe 18 when the sail is fully raised, as shown in FIG. 1*c*, an adapter 54 is affixed to the upper end of this crossbeam 44 to assume the guidance and locking of the upper crossbeam 44 until the sail has been moved into the half or fully reefed state shown in FIG. 1*b* and FIG. 1*c* respectively.

The crossbeams are made of grid-like frames preferably of lightweight metal or glass-fiber reinforced plastic and can be reefed individually and jointly by means of omitted reversing rollers, cables and winding motors mounted in the lower crossbeam 52 so as to pull down a sail section by mean of the next higher crossbeam and to reef the sail to this extent. When the sail is raised by means of the extending mast, the cables of the reefing system unwind in controlled manner from the winches of the winding motors. The cables of the reefing system of the upper crossbeam 44 pass through the lower crossbeam 48. The lower crossbeam 52 assumes an approximately trough-shape and is affixed approximately at the height of the deck to the outer pipe 12. When the sail is reefed, the crossbeam 52 receives the folded sail sections with the crossbeams lying on them. The reefing system is conventional and its operation will be understood by a person of ordinary skill in the art. Illustratively, a cable would be secured to the central crossbeam 48 through a roller and winding motor mounted in the lower crossbeam 52 so as to pull down the sail section 50 by means of the crossbeam 48 to reef the sail to the state shown in FIG. 1*b*. Another cable would be secured to upper crossbeam 44 through reversing the rollers and winding motor mounted in lower crossbeam 52 so as to fold down the sail section 46 by means of the crossbeam 54 to reef the sail to the state shown in FIG. 1*a*. Thus, the sail sections are raised by lengthening the mast or reefed by the motor driven reefing system with simultaneous mast shortening.

Figure 5:
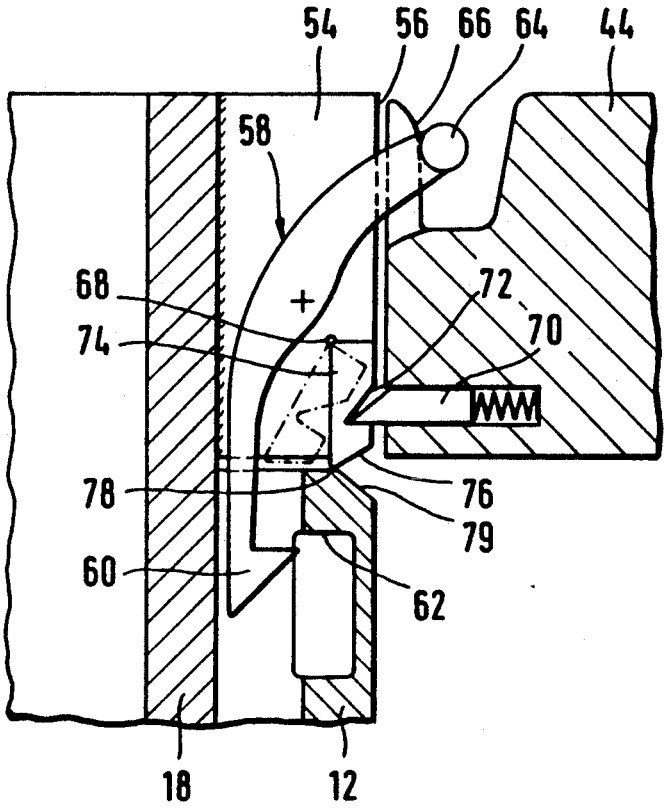

The adapter 54 shown in FIG. 5 is affixed to the outside of the upper end of the center pipe 18 and comprises external guide surfaces 56 extending the contour of the outer pipe 12. One or more pawl levers 58 are pivotably supported on vertical, axially parallel adapter surfaces and are elastically prestressed by their lower pawl ends 60 against an inside shoulder 62 of the outer pipe 12, so that automatic locking takes place between the central pipe 18 and the outer pipe 12 as soon as the central pipe has been fully retracted. Each pawl lever 58 bears at its upper, bent arm a bolt or a roller 64. When the sail is being raised from the state of FIG. 1*b* into that of FIG. 1*c*, the roller 64 is seized by a first cam surface 66 of the crossbeam 44, as a result of which the pawl lever 58 is pivoted clockwise into the position shown in FIG. 5 and the pawl end 60 gets off the shoulder 62. In addition to releasing the central pipe 18, the crossbeam 44 henceforth is secured against an upward motion relative to the adapter 54.

In order to secure the crossbeam 44 to the adapter 54 against relative downward motion when the sail is being raised and during sailing with raised sail, a latch 70 prestressed toward the adapter 54 is guided at the crossbeam 44 in such a manner that for the state shown by FIG. 5 it enters a clearance 72 of a retaining member 74 pivotable in the adapter about a horizontal axis 68. The retaining member 74 may be elastically prestressed in its shown lower end position wherein a second cam surface 76 projects from the adapter 54 and is opposite a stop 78 at the upper side of the outer pipe 12.

When the center pipe 18 is retracted into the outer pipe 12, the retaining member 74 arrives at the stop 78 and is pivoted clockwise into the position shown in dashed lines, whereby the latch 70 is freed from the clearance 72 and the locking of the crossbeam 44 to the adapter 54 is terminated. The crossbeam 44 now can be pulled down by the reefing device from the adapter to the outer pipe 12, the pawl lever 58 restoring the locking of the center pipe 18 to the outer pipe 12 and the latch 70 being forced back using a third slanted cam surface 79 on the outer pipe as far as into the crossbeam.

Figure 3:
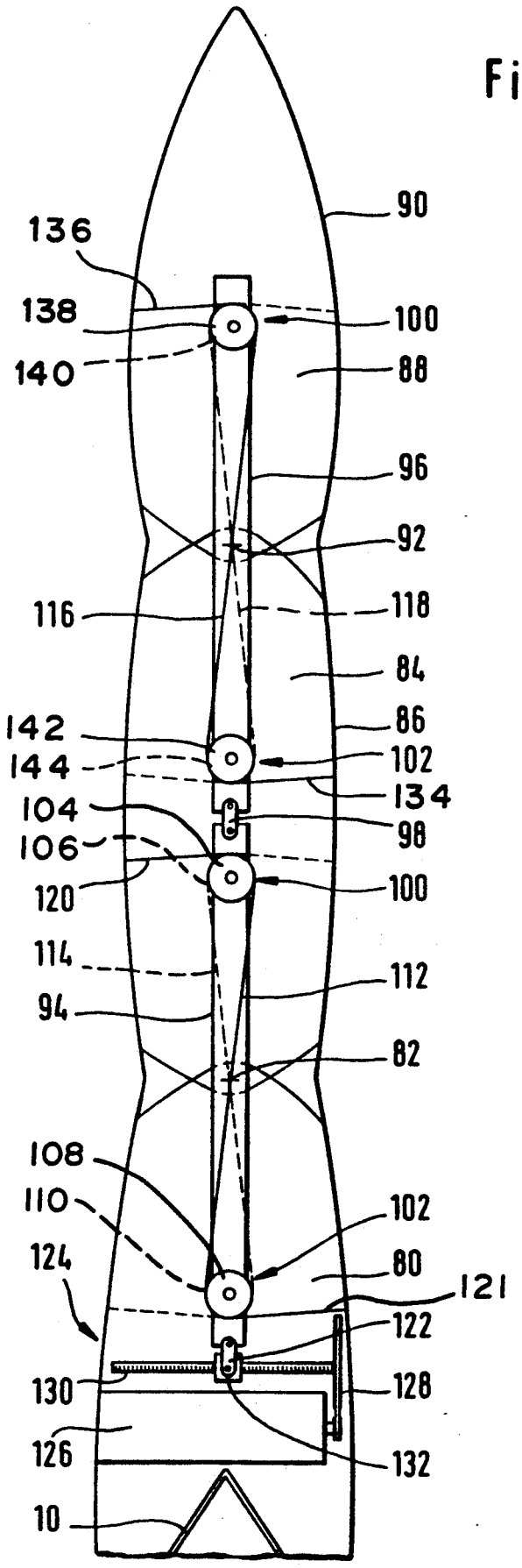

As shown by the topviews of FIGS. 3 and 4, each crossbeam consists of a rear crossbeam section 80 enclosing the mast 10 by a guide means and extending about two-thirds of the total length of the airfoil. A central crossbeam section 84 is connected to it by means of a vertical hinge shaft 82 and is bounded by slightly convex external sides 86. A front crossbeam section 88 with external sides 90 corresponding to the front end of an airfoil is articulated by a vertical hinge shaft 92 on the crossbeam section 84. A first lever 94 and a second lever 96 are centrally supported on the hinge shafts 82, 92 respectively and, for the embodiment shown, extend approximately as far as half the length of the particular crossbeam section, articulating on each other by means of a shackle 98. The levers are mounted inside the particular crossbeam and when the sails are taut are located in the longitudinal axis of the crossbeam.

Pairs of front and rear rollers or sprocket wheels 100,102 rotating about vertical axes and mounted in the same manner are present near the ends of the two levers 94, 96, each pair of rollers consisting of an upper and a lower roller and illustratively the upper roller is mounted above, an the lower roller below the lever. For the sake of clarity the reference numerals of the individual rollers are shown only for the rollers of the first lever 94. The upper rollers 104, 108 of the first lever 94 are looped from opposite directions by an articulating traction member, preferably a chain 112, the rear end 121 of the chain 112 being affixed to one side of the rear crossbeam part 80 and the front end 120 of this chain always being affixed at a lateral spacing from the particular roller. The lower rollers 106, 110 of the first lever 94 are looped by a chain 114 in mirror-symmetrical manner relative to the upper chain 112. In a similar design, an upper chain 116 affixed by its ends 134, 136 laterally to the central crossbeam part 84 and to the front crossbeam part 88 and passes around the upper rollers 138, 142 of the second lever 96. A lower chain 118 affixed to the opposite sides of the central crossbeam section 84 and front crossbeam part mounted in mirror-symmetrical manner thereto passes around the lower rollers 140, 144. The rear end of the first lever 94 is connected in articulating manner at the site 122 to a pivoting-adjustment drive 124 consisting in the embodiment shown of a threaded spindle 130 transversely supported on the rear crossbeam section 80 and driven by a motor 126 with gear-reduction 128. A nut 132 linked to the lever end is guided on the spindle.

Figures 4A, 4B, 4C:
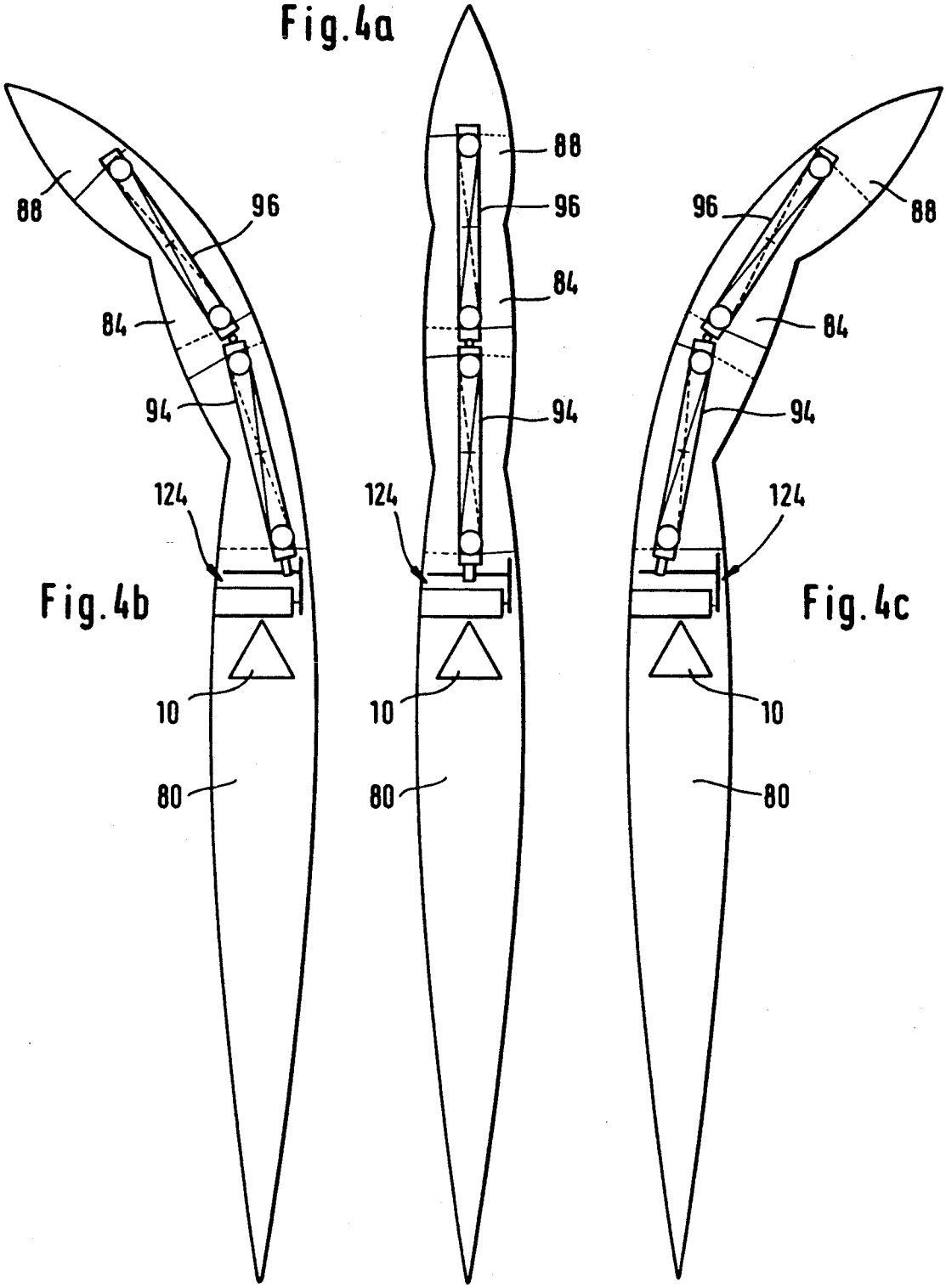

When upon actuation of the pivoting-adjustment drive 124, the rear end of the first lever 94 of FIG. 3 is pivoted to the left, the chain 112 passing over the upper rollers 104, 108 pulls the left external side of the central crossbeam section 84 toward the front end, pivoted rightward of this lever, so that the central crossbeam section 84 illustratively arrives at the position shown in FIG. 4*c*. At the same time the second lever 96 resting on the hinge shaft 92 at the front end of the central crossbeam section 84 is pivoted in the same direction, with the chain 116 passing over the upper rollers 138, 142 pulling by its left end the left external side of the front crossbeam section 88 toward the already pivoted lever, but this time with an additional transmission ratio.

When actuating the pivoting-adjustment drive 124 into the other direction, the particular crossbeam together with its individual crossbeam sections is made to assume an opposite curvature, whereupon the desired curvature distribution increasing forward at the airfoil is achieved. The covering of the particular sail sections evinces some elasticity allowing as needed to set any convex sail curvature, that is, curvature of the sail covering, by contact with the external sides of the crossbeam sections. As shown on the concave sail side in FIGS. 4*b* and 4*c*, where the coverings rest against the contours of the crossbeam sections, these coverings are held by omitted inner loops or eyelets to the side edges of the crossbeam sections.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An airfoil sail for a sailboat, comprising:

a) a mast;

b) a plurality of crossbeams including upper and lower crossbeams mounted one above the other at said mast, said crossbeams being raised or lowered individually at said mast;

c) sail sections secured to respective crossbeams and spanning the respective spacing between said crossbeams;

d) said crossbeams each including at least two corresponding crossbeam sections and a first vertical hinge shaft, said crossbeam sections being connected to each other by said hinge shaft and jointly corresponding to an airfoil, one of said crossbeam sections enclosing said mast;

e) each crossbeam including a pivoting drive for articulating said crossbeam sections thereby to adjust the curvature of said crossbeam and said airfoil;

f) said mast including a plurality of mutually telescoping pipes extendible to a plurality of positions, each position including at least one of said crossbeams; and g) means for selectively extending or retracting said telescoping pipes one pipe at a time to thereby lengthen or shorten said mast to one of said positions and raise or reef said sail sections together with the respective crossbeams.

2. An airfoil sail as in claim 1, wherein:

a) said telescoping pipes include inner, central and outer pipes; and b) an adapter having guide surfaces matching the cross-section of said outer pipe, said adapter being secured to an upper end of said central pipe and comprising locking means for locking said upper crossbeam to said adapter when said upper crossbeam is being raised and when said mast is fully extended.

3. An airfoil sail as in claim 2, wherein:

a) said locking means includes at least one pawl lever secured to said adapter in pivoting manner about a horizontal shaft;

b) said pawl lever includes lower and upper ends, said lower end being prestressed when said central pipe is retracted to engage an internal protrusion of said outer pipe;

c) said upper end of said pawl lever includes a roller; and d) said upper crossbeam includes a cam adapted to engage said roller when said upper crossbeam is raised such that said pawl lever is actuated to disengage said lower end from said internal protrusion, thereby disengaging said central pipe from said outer pipe.

4. An airfoil sail as in claim 2, wherein:

a) said locking means includes at least one retaining member prestressed in a lower end position;

b) said retaining member includes a clearance; and c) a prestressed latch guided in a slot in said upper crossbeam associated with said clearance in said retaining member, said latch securing said crossbeam against downward relative motion at said adapter, and said retaining member being disengageable from said latch when said adapter engages said outer pipe.

5. An airfoil sail as in claim 4, wherein:

a) said retaining member pivots about a horizontal axis and comprises a cam surface projecting beyond a lower side of said adapter when said retaining member is in its lower end position;

b) said outer pipe includes a stop disposed opposite said retaining member; and c) said stop includes a slanted cam surface for engaging and moving said latch into said slot.

6. An airfoil sail as in claim 1, wherein:

a) said crossbeam sections include front and rear crossbeam sections;

b) said pivoting drive includes a first lever mounted on said first vertical hinge shaft and extending into said front and rear crossbeam sections;

c) means for securing said first lever to said front and rear crossbeam sections such that moving said first lever about said first hinge shaft causes said front and rear crossbeam sections to articulate about said first hinge shaft.

7. An airfoil sail as in claim 6, and further comprising:

a) a pair of rollers, including upper and lower rollers, disposed one above the other on a vertical shaft and secured adjacent each end of said first lever;

b) an upper chain operatively engaged with said upper rollers, said upper chain having a front portion affixed to one side of said rear crossbeam section and a rear portion affixed to the opposite side of said front crossbeam section such that said upper rollers rotate in opposite directions when traversing said upper chain;

c) a lower chain operatively engaged with said lower rollers, said lower chain having a front portion affixed to the other side of said rear crossbeam section and a rear portion affixed to the opposite other side of said front crossbeam section such that said lower rollers rotate in opposite directions when traversing said lower chain;

d) said upper and lower chains are looped over respective upper and lower rollers in mirror-symmetrical manner; and e) said pivoting drive is connected to a rear end of said first lever for shortening or lengthening said upper and lower chains front portions to thereby pull said front crossbeam to one side about said first vertical hinge shaft thereby adjusting the airfoil curvature.

8. Airfoil sail as in claim 6, wherein:
a) said pivoting drive comprises a driven threaded spindle; and
b) a nut connected in articulating manner with said first lever and guided on said spindle.

9. An airfoil sail as in claim 1, wherein:
a) said crossbeam sections include front, central and rear crossbeam sections and a second hinge shaft;
b) said front, central and rear crossbeam sections are mounted sequentially on respective first and second hinge shafts, said rear crossbeam enclosing said mast;
c) said pivoting drive includes a first lever mounted on said first hinge shaft and extending into said rear and central crossbeam sections;
d) a second lever pivotally linked to said first lever, said second lever being mounted on said second hinge shaft, said second lever extending into said central and front crossbeam sections;
e) a pair of rollers, including upper and lower rollers, disposed one above the other on a vertical shaft and secured adjacent each end of said first and second levers;
f) an upper chain for each of said first and second levers, said upper chain passes over both upper rollers, said upper chain having a front portion affixed to one side of one of said crossbeam sections and a rear portion affixed to the opposite side of the adjacent crossbeam section such that said upper rollers rotate in opposite directions when traversing said upper chain;
g) a lower chain for each of said first and second levers, said lower chain passes over both lower rollers, said lower chain having a front portion affixed to one side of one of said crossbeam sections and a rear portion affixed to the opposite side of the adjacent crossbeam section such that said lower rollers rotate in opposite directions when traversing said lower chain;
h) said upper and lower chains are looped over respective upper and lower roller in mirror-symmetrical manner; and
i) said pivoting drive is connected to a rear end of said first lever for shortening or lengthening said upper and lower chains front portions to thereby pull said crossbeam sections affixed to said chains to one side about said first and second hinge shafts thereby adjusting the airfoil curvature.

10. An airfoil said as in claim 9, wherein:
a) said first and second levers are disposed within respective crossbeams.

11. Airfoil sail as in claim 1, wherein:
a) said crossbeam sections have tapered connection ends that overlap with each other about said hinge shaft.

12. Airfoil sail as in claim 1, wherein:
a) said pivoting drive is mounted on said crossbeam section enclosing said mast.

13. Airfoil said as in claim 1, wherein:
a) said telescoping pipes include inner, central and outer pipes;
b) said telescoping pipes being adapted such that said inner and central pipes can be retracted into said outer pipe; and
c) releasable locking means for securing said central pipe to said outer pipe such that said inner pipe is extended first when said mast is being raised.

14. Airfoil sail as in claim 13, and further comprising:
a) inner guide rollers disposed at an upper end inner periphery of said central and outer pipes;
b) outer guide rollers disposed at a lower end outer periphery of said inner and central pipes; and
c) said inner and outer guide rollers are adapted to guide said inner pipe through said central pipe and said central pipe through said outer pipe.

15. Airfoil sail as in claim 13, and further comprising:
a) a winch;
b) a cable secured to said winch; and
c) reverse rollers operably secured to said pipes, said cable is operatively engaged with said reverse rollers such as to lower or raise said pipes when said winch is operated.

16. Airfoil sail as in claim 1, wherein:
a) each of said telescoping pipes is substantially the same length and substantially corresponds to the largest vertical distance between adjacent crossbeams.

17. An airfoil sail for a sailboat, comprising:
a) a mast;
b) a crossbeam secured to said mast;
c) a sail secured to said mast and said crossbeam;
d) said crossbeam including at least two corresponding crossbeam sections, including front and rear crossbeam sections and a first vertical hinge shaft, said front and rear crossbeam sections being connected to each other by said hinge shaft and jointly corresponding to an airfoil, said rear crossbeam section enclosing said mast;
e) a first lever mounted on said hinge shaft and extending into said front and rear crossbeam sections;
f) a pair of rollers, including upper and lower rollers, disposed one above the other on a vertical shaft and secured adjacent each end of said first lever;
g) an upper chain operatively engaged with said upper rollers, said upper chain having a front portion affixed to one side of said rear crossbeam section and a rear portion affixed to the opposite side of said front crossbeam section such that said upper rollers rotate in opposite directions when traversing said upper chain;
h) a lower chain operatively engaged with said lower rollers, said lower chain having a front portion affixed to one side of said rear crossbeam section and a rear portion affixed to the opposite side of said front crossbeam section such that said lower rollers rotate in opposite directions when traversing said lower chain;
i) said upper and lower chains are looped over respective upper and lower roller in mirror-symmetrical manner; and
j) a pivoting drive connected to a rear end of said first lever for shortening or lengthening said upper and lower chains front portions to thereby pull said front crossbeam section affixed to said chains to one side about said first vertical hinge shafts thereby adjusting the airfoil curvature.

18. An airfoil sail as in claim 17, wherein:
a) said crossbeam includes a central crossbeam section and a second vertical hinge shaft, said front, central and rear crossbeam sections being mounted sequentially on respective first and second hinge shafts, said rear crossbeam enclosing said mast;
b) a second lever pivotally linked to said first lever, said second lever being mounted on said second hinge shaft, said second lever extending into said central and front crossbeam sections;

c) a pair of rollers, including upper and lower rollers, disposed one above the other on a vertical shaft and secured adjacent each end of said first and second levers;

d) an upper chain for each of said first and second levers, said upper chain passes over both upper rollers, said upper chain having a front portion affixed to one side of one of said crossbeam sections and a rear portion affixed to the opposite side of the adjacent crossbeam section such that said upper rollers rotate in opposite directions when traversing said upper chain;

e) a lower chain for each of said first and second levers, said lower chain passes over both lower rollers, said lower chain having a front portion affixed to one side of one of said crossbeam sections and a rear portion affixed to the opposite side of the adjacent crossbeam section such that said lower rollers rotate in opposite directions when traversing said lower chain;

f) said upper and lower chains are looped over respective upper and lower roller in mirror-symmetrical manner; and g) said pivoting drive is connected to a rear end of said first lever for shortening or lengthening said upper and lower chains front portions to thereby pull said crossbeam sections affixed to said chains to one side about said first and second hinge shafts thereby adjusting the airfoil curvature.

19. An airfoil sail as in claim 18, wherein:

a) said first and second levers are disposed within said crossbeam.

20. An airfoil sail as in claim 17, wherein:

a) said pivoting drive comprises a driven threaded spindle; and b) a nut connected in articulating manner with said first lever and guided on said spindle.

21. An airfoil sail as in claim 17, wherein:

a) said pivoting drive is mounted on said rear crossbeam section in front of said mast.

22. An airfoil sail for a sailboat, comprising:

a) a mast;

b) a plurality of crossbeams including upper, middle and lower crossbeams mounted one above the other at said mast, said crossbeams being raised or lowered individually at said mast;

c) sail sections secured to respective crossbeams and spanning the respective spacing between said crossbeams;

d) said mast including a plurality of mutually telescoping pipes including inner, central and outer pipes;

e) means for extending said telescoping pipes to thereby lengthen said mast and raise sail sections together with the respective crossbeams suspended from them and retracting said pipes to thereby shorten said mast and reef said sail sections;

f) said telescoping pipes being adapted such that said inner and central pipes can be retracted into said outer pipes; and g) releasable locking means for securing said central pipe to said outer pipe such that said inner pipe is extended first when said mast is being raised.

23. An airfoil sail as in claim 22, and further comprising:

a) inner guide rollers disposed at an upper end inner periphery of said central and outer pipes;

b) outer guide rollers disposed at a lower end outer periphery of said inner and central pipes; and c) said inner and outer guide rollers are adapted to guide said inner pipe through said central pipe and said central pipe through said outer pipe.

24. Airfoil sail as in claim 22, and further comprising:

a) a winch;

b) a cable secured to said winch; and c) reverse rollers operably secured to said pipes, said cable is operatively engaged with said reverse rollers such as to lower or raise said pipes when said winch is operated.

25. An airfoil sail as in claim 22, wherein:

a) said locking means including means for cooperating with said upper crossbeams such that said locking means is released when said upper crossbeam is being raised.

* * * * *